United States Patent [19]

Burton et al.

[11] 4,256,267

[45] Mar. 17, 1981

[54] RECOVERY OF MINERALS FROM ULTRA-BASIC ROCKS

[75] Inventors: Phillip F. Burton, Phalaborwa, South Africa; Risto T. Hukki, Otaniemi, Finland

[73] Assignee: Foskem (Proprietary) Limited of "Wegsteek", Phalaborwa, South Africa

[21] Appl. No.: 966,886

[22] Filed: Dec. 6, 1978

[30] Foreign Application Priority Data

Dec. 13, 1977 [ZA] South Africa ..... 77/7409
Nov. 17, 1978 [ZA] South Africa ..... 78/6464

[51] Int. Cl.[3] ..... B07B 15/00

[52] U.S. Cl. ..... 241/24; 209/12; 209/38; 209/39; 209/214

[58] Field of Search ..... 209/3, 12, 2, 38–40, 209/127 R, 129, 212–214; 241/24, 26

[56] References Cited

U.S. PATENT DOCUMENTS

| | | | |
|---|---|---|---|
| 3,022,890 | 2/1962 | Snow | 209/127 R X |
| 3,022,956 | 2/1962 | Haseman | 209/215 X |
| 3,032,189 | 5/1962 | Adam et al. | 209/214 X |
| 3,032,190 | 5/1962 | Le Baron | 209/214 X |
| 3,326,474 | 6/1967 | Clary et al. | 241/24 X |

*Primary Examiner*—Ralph J. Hill
*Attorney, Agent, or Firm*—Omri M. Behr

[57] ABSTRACT

A process for the metallurgical treatment of pyroxenite-type ore, which comprises comminuting the ore to a particle size range of between about 40 and 600 micron, or alternatively between about 40 to 1000 micron, and thereafter subjecting the comminuted ore to dry HIMS to recover a non-attracted apatite concentrate from weakly attracted silicate minerals contained in the pyroxenite ore. Another aspect of the invention relates to the recovery of phlogopite and/or vermiculite from more weakly attracted diopside and non-attracted apatite by dry HIMS. A further aspect of the invention relates to particle size fractionation by pneumatic classification followed by dry HIMS, electrostatic separation and dry HIMS, and electrostatic separation alone, applied respectively to fine, medium, and coarse particle size fractions respectively to recover apatite from silicate minerals contained in pyroxenite ore.

48 Claims, 9 Drawing Figures

FIG. 7
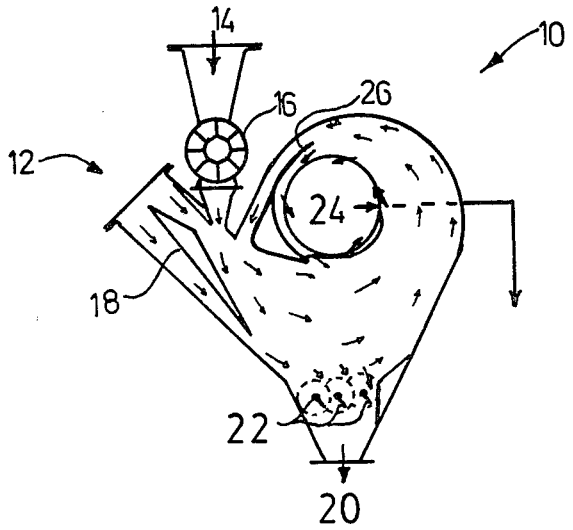
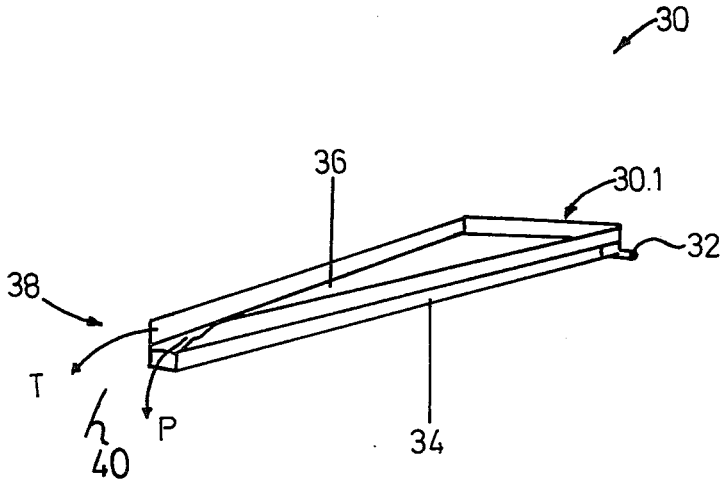
FIG. 8

RECOVERY OF MINERALS FROM ULTRA-BASIC ROCKS

BACKGROUND OF THE INVENTION

The exploitation and economically successful reovery of apatite in recent decades from the ultrabasic rock deposits of the Phalaborwa Igneous Complex in the Republic of South Africa constituted a major breakthrough in metallurgy because of the exceptionally low grade of the ore on the one hand and the vast reserves made available thereby on the other hand.

Initially the commercial activities were confined to an ore rock which became known as foskorite and in which the apatite percentage (though low by conventional standards) was higher than in the remainder of the complex. The key to the successful concentration and purification of apatite from foskorite (developed after prolonged experimentation with numerous ore-dressing methods) became a novel flotation process.

Some years later after prolonged and diverse experimentation, further flotation techniques had been invented and developed which also permitted the successful exploitation of the vast amounts of apatite in the even lower grade pyroxenite types of apatite ore of the complex. These processes have been in commercial use for some 10 years and have been so successful, both in respect of recoveries (up to 90%) and grade, that experts in the art were quite satisfied that flotation constituted the only effective answer to the problems of recovering apatite from this kind of rock.

In the circumstances, and particularly after experiments with sophisticated wet HIMS (HIMS=high intensity magnetic separation) techniques had yielded no useful results at all, it was firmly believed that the only prospects for further improvement lay in refinements of the flotation techniques. This view was adopted and accepted in spite of the drawbacks inherent in flotation, i.e.

(a) high energy requirements,
(b) many moving parts in the equipment
(c) high wear and tear,
(d) costly chemicals,
(e) large water requirements,
(f) severe effluent disposal problems,
(g) fines and slimes problems, including disposal thereof,
(h) need for careful control and frequent adjustments,
(i) sensitivity to variations in the ore and gangue minerals,
(j) grinding the ore to a small particle size and attendant problems,
(k) high capital and running costs of auxiliary equipment such as pumps, thickeners, filters, drying plant, dust control equipment etc.

Moreover, it was not possible to improve economically all quality aspects of the recovered apatite to satisfy all technical requirements including those of potential export markets. Particular problems were experienced with the MgO content of the recovered apatite, namely typically 2% MgO in the case of foskorite concentrates and typically 1.1% MgO in the more abundant pyroxenite concentrates. Even the latter MgO content is far above many acceptable limits.

For the manufacture of diammonium phosphate (a particularly popular fertiliser in overseas markets) a limit of 0.6% MgO is prescribed. For the manufacture of superphosphoric acid and technical high grade phosphate the upper limit is 0.3% MgO in the rock phosphate.

It is clear therefore that there has existed a real need for improvement in any one or more of the aforementioned respects.

The present invention is based on the quite surprising and unexpected result of careful experimentation that in certain circumstances to be more fully explained below, it is possible to attain very good recoveries of apatite from pyroxenite ore, often even better recoveries than by the best flotation techniques known to the applicant, and that moreover, the MgO-content is usually considerably lower than when the same ore is concentrated by flotation-often sufficiently low to satisfy the most stringent purity requirements by world standards.

These results are particularly surprising in the light of previous complete failures to attain useful results by wet HIMS methods, even though these experiments had been carried out by experts in those methods and with sophisticated equipment. Normally the results of wet HIMS are a reliable indication of results to be expected with dry HIMS techniques.

The applicant is also aware that dry HIMS has previously been used in relation to phosphate-containing ores, for example as disclosed in U.S. Pat. No. 3,022,956 granted on Feb. 27, 1962. However, such prior use of dry HIMS has been confined to the context of separating highly ferromagnetic material, for example, magnetic and similar iron-ore minerals, from apatite.

The pyroxenite ore of the Phalaborwa Igneous Complex comprising apatite, phlogopite and/or vermiculite and diopside is naturally an entirely different raw material when compared to magnetite-phosphate type ores, and hence presents an entirely different and new metallurgical problem. The crux of this difference is to be found in the absence or virtual absence of ferromagnetic minerals in these pyroxenite ores, with the result that the mineral components to be separated are either non-attracted or only weakly attracted. Magnetic separation would therefore not appear to provide a solution to the separation of the various mineral components present in these pyroxenite type ores.

SUMMARY OF THE INVENTION

It is therefore an object of the present invention to provide an improved process for the separation of mineral compounds, i.e. pyroxenite-type ores, when carried out in accordance with the disclosure contained herein as well as the knowledge and experience of the inventors and the applicant.

In accordance with the present invention there is provided a process for the metallurgical treatment of apatite ore, which comprises subjecting a pyroxenite type ore in comminuted form and predominantly composed of particles in the size range from 40 micron upwards, e.g. up to 600 micron, more particularly between 400 and 100 micron, preferably between 350 and 120 micron, more preferably between 300 and 150 micron, as determined by screen analysis, to dry HIMS to recover a non-attracted fraction composed essentially of an apatite concentrate separated from silicate minerals of the pyroxenite ore as attracted fractions.

Preferably in excess of 70% by mass, more preferably in excess of 80%, advantageously from 90% upwards of the comminuted ore is in a particle size range as defined above.

The optimum parameters for the HIMS fractionation depend on the equipment used and can easily be determined empirically by persons skilled in the art, if care is taken that the material to be fractionated is subjected to a moderate field strength initially, which field strength increases continuously or in appropriate stages as the material passes through the process. Apatite will be entrained with the weakly magnetic gangue minerals if the initial field strength is too high.

The following preferred fractionating conditions were determined, using the well-known "Frantz" isodynamic HIMS separator as manufactured by S. G. Frantz, Co., Inc., Trenton, N.J.:

first stage: 6,000–8,000 Gauss, preferably 6,500–7,500, say 7,000 Gauss.

Second stage: 8,500–10,500 Gauss, preferably 9,000–10,000 say 9,500 Gauss.

Final (cleaning) stage: 12,000–20,000, more preferably 15,000–19,000, say 18,500 Gauss.

These conditions can easily be modified to carry out the process analogously on a large scale, e.g. with induced roll machines, or with permanent magnet machines. A scalper stage at approximately 2,000 Gauss, may be employed prior to the first stage to remove ferromagnetic material. Conventional principles of recycling tailings or intermediate fractions are applied.

Preferably the ore is one which besides apatite contains mainly diopside and phlogopite and/or vermiculite as diluent (gangue) minerals, preferably substantially exclusively. Small contaminations of calcite and/or felspar are normally not objectionable. Even relatively large concentrations of calcite are not objectionable if the apatite concentrate is either subjected to a flotation stage to separate apatite from calcite (e.g. as described in one or more of RSA patent specifications Nos. 64/3405, 67/0921, 72/7149, 75/8043, 76/0660 and 76/0661) or is admixed in small amounts to concentrates from pyroxenite, containing little or no calcite.

Surprisingly it was found that the dry HIMS technique in the stated particle range can be even effective to recover from the weakly attracted minerals a further fraction consisting essentially of highly concentrated phlogopite. In other words, the process succeeds in achieving also an effective separation of phlogopite and/or vermiculite from diopside. Because the phlogopite and/or vermiculite can thus be recovered with little additional effort, it can become a useful further product, particularly in the case of phlogopite. Phlogopite can serve as a commercial source of potash and also of aluminium, whilst vermiculite contains no potash.

At Phalaborwa phlogopite has been wholly or partly changed to vermiculite in the weathered ore zone above the water table. Below the water table only phlogopite is present.

Thus according to a further aspect of the invention there is provided a process which comprises subjecting a comminuted pyroxenite material predominantly in a particle size range as above defined to dry HIMS to recover a weakly attracted fraction composed essentially of a magnetically attracted phlogopite and/or vermiculite concentrate separated from less strongly attracted diopside and non-attracted apatite.

Here again, it may be desirable to raise the field strength progressively or in distinct stages as the material passes through the process to avoid contamination of the attracted phlogopite by entrained weakly attracted or non-attracted accompanying materials.

The present HIMS method of separation does not or not materially distinguish between phlogopite and vermiculite. However, if desired, these two minerals may be separated from one another in a separate step, e.g. by winnowing (air flow separation).

When using the "Frantz" isodynamic HIMS separator, the appropriate conditions are as follows if apatite has already been separated out.

Here it is usually found that a single step separation at 8,000 to 12,000, preferably 10,000 Gauss suffices for adequate separations and recoveries.

If it is desired to recover apatite and phlogopite as separate products in a single run through the HIMS section of the process, the appropriate conditions are (using the "Frantz" isodynamic HIMS separator) essentially as set out above in the context of purifying apatite. Under the conditions stated (which in practice can be applied in a number of variations and with various refinements such as recycling of middling fractions), it is found that the magnetic fraction recovered at 8,000 to 12,000 Gauss, preferably 10,000 Guass is often almost pure phlogopite and/or vermiculite.

Here as well, the person skilled in the art can apply the aforegoing principles analogously to other dry HIMS apparatus.

The particle size range, more particularly as defined above, was found to have a strong influence on the recoveries and on the purity of the apatite recovered.

Larger particle sizes, say larger than 750 micron or even larger than 400 micron, have an adverse effect, possibly because of inadequate liberation of the different mineral species, but possibly mainly because of a "band-spreading" effect which occurs if the particle size range is too broad. It is preferred therefore to work with particles in reasonably narrow size ranges with dry HIMS.

Below the particle size stated (which includes the size range best suited for flotation), the particles are too fine for the attainment of satisfactory results. The −40 micron fraction is, relatively speaking, well suited for flotation purposes.

It is particularly significant that, by conventional milling techniques, it is possible (at substantially lower cost than that of milling to the finer particle size required for flotation) to attain a milled product of which at least 60% by mass, usually up to 70%, and with careful handling and selection of techniques even more, is in the range of 400 to 100 micron. As a further feature of preferred embodiments of the process, the fines are separated and processed for further apatite recoveries by different techniques, e.g. the existing flotation processes for which these fines are ideal.

In these conditions it is possible in the appropriate circumstances to employ existing flotation facilities for the flotation concentration of the fines, whilst enlarging the capacity of the plant as a whole by the addition of dry HIMS apparatus and the enlargement of milling capacity where required and addition of appropriate classification apparatus.

The latter may include conventional screening apparatus, such as sieve bends or cyclones. However, in order to avoid having to dry the classified material, it is preferred to employ a dry classification process, in particular air classification.

In certain circumstances it may also be found that the fines can be fractionated satisfactorily (in the context of overall quality and economy considerations) by wet HIMS fractionation. Such combination process wherein the coarse particle sizes are subjected to dry HIMS whilst the fines are fractionated by wet HIMS would also be an embodiment of the invention.

Milling preferably takes place under dry conditions to eliminate the need for subsequent drying.

According to a further preferred feature of the invention, autogenous milling is employed (which, besides savings in respect of steel, also eliminates secondary and tertiary crushing). By optimising the combination of this technique with pneumatic classification, it is expected that yields of up to 80 or even 90% may be attainable in the particle size range desired for the dry HIMS separation stage. Friable ore types which occur in relatively small quantities in the Phalaborwa Igneous Complex are more satisfactorily milled under semi-autogenous conditions or when mixed with the more common types of ore.

According to a further aspect of the invention, the process may include the steps of separating the pyroxenite ore in comminuted form and predominantly composed of particles in the size range of about 40 to 1000 micron, as determined by screen analysis, into three particle size streams, subjecting the relatively fine particles to dry high intensity magnetic separation, subjecting the medium size particles to dry high intensity magnetic separation preceded by electrostatic separation, and subjecting the relatively coarse particles solely to electrostatic separation, to recover a non-attracted fraction composed essentially of an apatite concentrate separated from one or more weakly attracted fractions.

The relatively fine particles may be in the size range of about 40 to 300 micron, the medium size particles may be in the size, range of about 300 to 600 micron, and the relatively coarse particles may be in the size range of about 600 to 1000 micron.

The process may include the step of subjecting the comminuted ore to pneumatic classification to obtain the desired particle size streams prior to the magnetic and/or the electrostatic separation. Pneumatic classification may preferably be carried out by means of at least one closed-circuit combined pneumatic classifier and cyclone unit (as described hereinafter).

The scope of the invention also extends to plant comprising an apparatus combination laid out to perform a process in accordance with the invention as set out above.

More particularly there is provided a metallurgical plant suitable for the purposes set out, comprising in combination (a) a milling installation, followed by (b) dry classification equipment, followed by (c) dry HIMS apparatus.

More particularly, the milling installation is of the autogenous dry type. Also preferably the classification equipment is an air classification apparatus.

Preferably the classification equipment is adapted to feed a fines fraction into a flotation installation or a wet HIMS apparatus, preferably the former.

Further preferred or alternative features of the apparatus are apparent from the aforegoing description of the process.

BRIEF DESCRIPTION OF THE DRAWINGS

FIG. 7 is an elevational cross section of a Hukki classification.

FIG. 8 is a perspective plan view of a pneumatic pinched sluice.

DESCRIPTION OF SPECIFIC EXAMPLES

EXAMPLE 1

Figure 1:
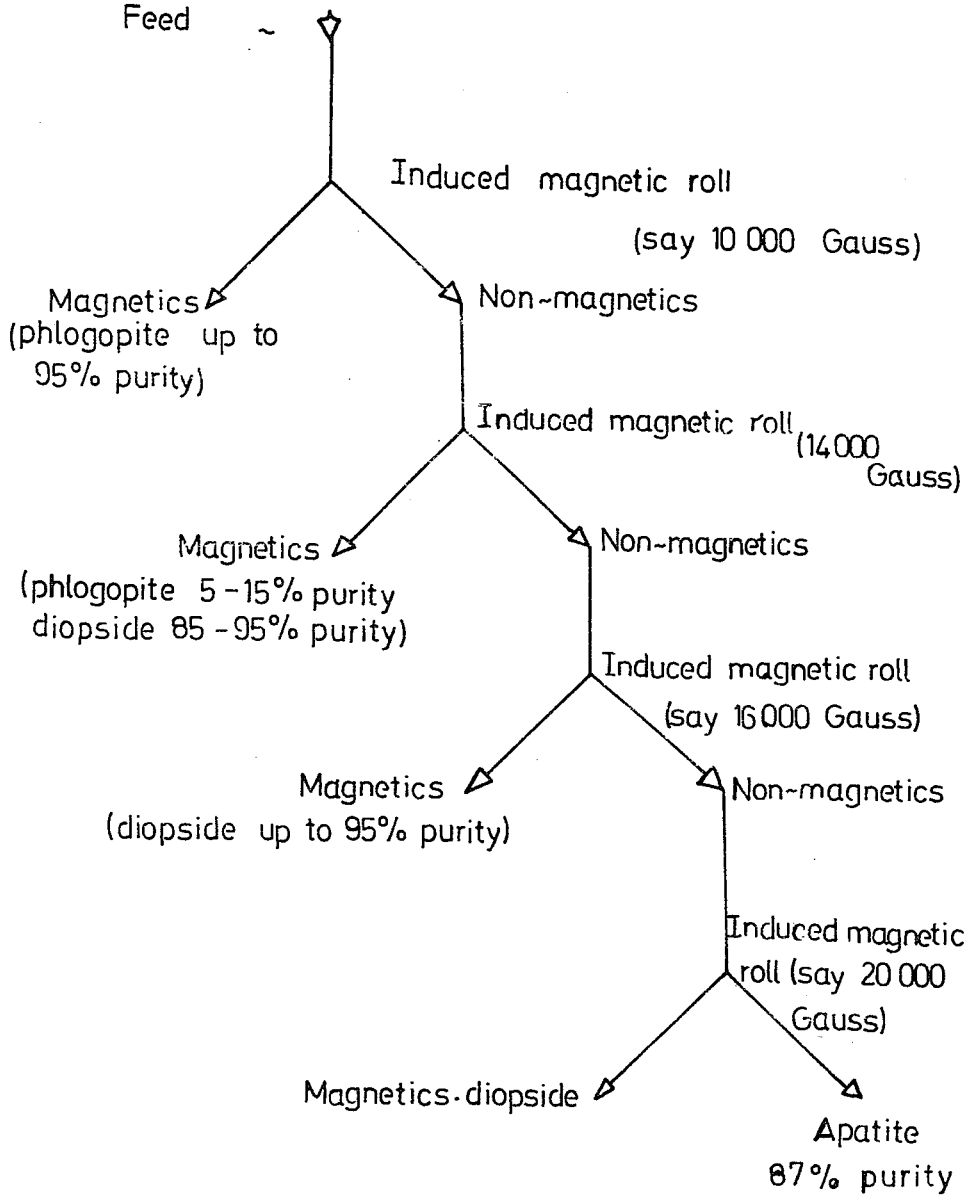
FIG. 1 is a flow diagram indicating the steps taken to separate apatite from a feedstock of apatite containing pyroxenite.

Various borehole samples of apatite-containing pyroxenite taken from the Phalaborwa Igneous Complex were crushed, milled and divided into fractions according to particle size by screening and subjected to dry HIMS fractionation in a "Frantz" isodynamic separator.

Each fraction was passed through the apparatus three times (returning the non-magnetic fraction to the hopper) to simulate rougher, cleaner and recleaner stages.

The transverse angle of the apparatus was set at +10° and the longitudinal angle at +25°.

The field strengths employed were:

first stage 7,000 Gauss, second stage 9,500 Gauss, final (cleaner) stage 18,500 Gauss.

In the majority of the experiments the magnetic fraction of the first stage at 7,000 Gauss turned out to be almost pure (about 95% by mass) phlgopite. The magnetic fraction of the second stage (at 9,500 Gauss) turned out to be substantially diopside.

The results in respect of apatite are summarised in the following table:

| Borehole No. | Depth (feet) | Laboratory results of dry HIMS separation | Particle size range (micron) 425/300 | 300/150 | 150/75 |
|---|---|---|---|---|---|
| 600/1525 | 0–106 | Feed % $P_2O_5$ | 2,8 | 3,17 | 4,81 |
| | | Concentrate % $P_2O_5$ | 25,7 | 27,2 | 27,6 |
| | | Recovery % | 68,6 | 70,9 | 55,6 |
| | | % MgO in concentrate | 0,91 | 0,7 | 0,88 |
| 500/1 200 | 453–500 | Feed % $P_2O_5$ concentrate | 7,12 | 10,6 | 12,6 |
| | | % $P_2O_5$ | 38,7 | 39,4 | 35,9 |
| | | recovery % | 95,2 | 97,4 | 36,0 |
| | | % MgO in concentrate | 0,19 | 0,17 | 1,6 |
| 400/1 200 | 331–374 | Feed % $P_2O_5$ concentrate | 5,01 | 7,79 | 8,79 |
| | | % $P_2O_5$ | 39,8 | 39,4 | 40,4 |
| | | recovery % | 77,7 | 91,0 | 24,4 |

-continued

| Borehole No. | Depth (feet) | Laboratory results of dry HIMS separation | Particle size range (micron) 425/300 | 300/150 | 150/75 |
|---|---|---|---|---|---|
| | | % MgO in concentrate | 0,16 | 0,17 | 0,19 |
| | | Feed % $P_2O_5$ | 3,79 | 6,97 | 8,58 |
| | | Concentrate % $P_2O_5$ | 34,1 | 35,9 | 35,4 |
| 300/1 200 | 307–366 | | | | |
| | | recovery % | 67,5 | 88,0 | 75,5 |
| | | % MgO in concentrate | 0,26 | 0,24 | 0,28 |
| | | Feed % $P_2O_5$ | 14,9 | 18,4 | 20,3 |
| | | Concentrate % $P_2O_5$ | 40,5 | 40,6 | 39,4 |
| 600/1 300 | 494–524 | | | | |
| | | recovery % | 97,5 | 95,8 | 97,8 |
| | | % MgO in concentrate | 0,23 | 0,18 | 0,19 |
| | | Feed % $P_2O_5$ | 5,55 | 9,08 | 10,9 |
| | | Concentrate % $P_2O_5$ | 39,5 | 39,8 | 39,6 |
| 400/1 100 | 140–185 | | | | |
| | | recovery % | 94,6 | 98,5 | 69,5 |
| | | % MgO in concentrate | 0,34 | 0,29 | 0,24 |
| | | Feed % $P_2O_5$ | 6,57 | 7,79 | 7,44 |
| | | Concentrate % $P_2O_5$ | 12,7 | 13,0 | 12,7 |
| 600/1 200 | 378–433 | | | | |
| | | recovery % | 95,2 | 93,8 | 46,2 |
| | | % MgO in concentrate | 1,9 | 0,3 | 0,6 |
| | | Feed % $P_2O_5$ | 4,0 | 7,8 | 5,5 |
| | | Concentrate % $P_2O_5$ | 39,6 | 39,6 | 39,4 |
| 400/1 300 | 233–300 | | | | |
| | | Recovery | 84,5 | 91,2 | 88,0 |
| | | % MgO in concentrate | 0,2 | 0,3 | 0,2 |
| | | Feed % $P_2O_5$ | 9,78 | 13,62 | 16,29 |
| | | Concentrate % $P_2O_5$ | 38,5 | 39,7 | 36,8 |
| 600/1 300 | 273–327 | | | | |
| | | Recovery % | 88,3 | 91,2 | 77,3 |
| | | % MgO in concentrate | 0,7 | 0,3 | 1,3 |
| | | Feed % $P_2O_5$ | 4,42 | 6,78 | 8,78 |
| | | Concentrate % $P_2O_5$ | 36,4 | 37,0 | 37,0 |
| 400/1 500 | 464–500 | | | | |
| | | Recovery % | 93,6 | 98,5 | 74,6 |
| | | % MgO in concentrate | 0,2 | 0,2 | 0,1 |
| | | Feed % $P_2O_2$ | 8,41 | 11,8 | 12,8 |
| | | Concentrate % $P_2O_5$ | 40,1 | 39,4 | 39,4 |
| 500/1 500 | 390–455 | | | | |
| | | Recovery % | 78,4 | 89,4 | 72,4 |
| | | % MgO in concentrate | 0,3 | 0,3 | 0,3 |
| | | Feed % $P_2O_5$ | 10,29 | 14,4 | 11,9 |
| | | Concentrate % $P_2O_5$ | 40,2 | 40,0 | 40,0 |
| 400/1 200 | 0–122 | | | | |
| | | Recovery % | 87,3 | 94,6 | 94,0 |
| | | % MgO in concentrate | 0,3 | 0,3 | 0,3 |
| | | Feed % $P_2O_5$ | 8,76 | 10,9 | 13,1 |
| | | Concentrate % $P_2O_5$ | 36,9 | 37,4 | 35,0 |
| 500/1 200 | 174–230 | | | | |
| | | Recovery % | 96,1 | 96,7 | 72,7 |
| | | % MgO in concentrate | 0,7 | 0,3 | 0,5 |
| | | Feed % $P_2O_5$ | 8,13 | 10,6 | 11,3 |
| | | Concentrate % $P_2O_5$ | 36,3 | 37,4 | 35,6 |
| 500/1 200 | 398–453 | | | | |
| | | Recovery % | 96,0 | 92,3 | 95,1 |

-continued

| Borehole No. | Depth (feet) | Laboratory results of dry HIMS separation | Particle size range (micron) 425/300 | 300/150 | 150/75 |
|---|---|---|---|---|---|
| | | % MgO in concentrate | 1,4 | 1,3 | 1,7 |
| | | Feed % $P_2O_5$ | 2,57 | 3,43 | 5,72 |
| | | Concentrate % $P_2O_5$ | 39,3 | 38,6 | 39,6 |
| 86 | 0–111 | | | | |
| | | Recovery % | 92,7 | 73,4 | 77,5 |
| | | % MgO in concentrate | — | 0,5 | 0,2 |
| | | Feed % $P_2O_5$ | 3,98 | 6,97 | 9,35 |
| | | Concentrate % $P_2O_5$ | 38,8 | 39,7 | 39,6 |
| 89 | 456–535 | | | | |
| | | Recovery % | 83,9 | 83,0 | 95,8 |
| | | % MgO in concentrate | 0,6 | 0,3 | 0,3 |

It will be seen that almost without exception the samples in the 300/150 micron range produced highly satisfactory results. The recoveries were excellent and the MgO contents, almost throughout satisfied the most stringent requirements. The results reflect the highest purity commercial phosphate attained anywhere in the world.

In some cases even coarser or finer particles still yielded satisfactory results. However, on average the results in those size ranges are inclined to be erratic. The fine fractions are excellently suitable for flotation, e.g. as described in one or more of RSA patent specifications Nos. 64/3405, 67/0921, 72/7149, 75/8043, 76/0660 and 76/0661.

Low grades of apatite are observed where there are deposits of calcite and/or felspar, both of which are non-magnetic and would therefore report in the apatite fraction. The recovery of apatite would still be high.

The first sample of the table represents an exceptional ore comprising an abnormal calcite content. Calcite occurs only in small pockets of the Phalaborwa Complex.

The sample from bore hole No. 600/1200 at 378–433 feet is also abnormal in that it had an unusually high calcite content. This was due to small calcite veins in the rock.

This explains the low phosphate content of the concentrate. Such concentrates if mixed in with other concentrates is not objectionable. However, if the average calcite would be raised too much by such a procedure, it is easy to separate the apatite from the calcite in the concentrate by flotation, e.g. as described in one or more of the afore-cited patents, if desired suitably adapted in a manner readily understood by persons skilled in the art. In the areas investigated, the calcite veins represent less than 1% of the total ore mass.

The sample taken from borehole No. 500/1200 of 398–453 ft. is abnormal in that it probably contained some dolomite, thus accounting for high MgO values. Dolomite is removable by subsequent purification if necessary, e.g. by flotation.

The erratic recoveries in the sample from borehole 86 are due to calcite and/or felspar or some other unusual cause.

Very substantial savings and advantages have been observed or calculated when comparing the present process with commercial processes previously practised on the same type of ore:

1. The apatite concentrate can easily be made (in the case of almost all samples tested) to satisfy the highest purity standards, in particular as regards MgO content.
2. Attainable capital savings, based on present costs are estimated to amount to about 60% as compared with a flotation plant of the same capacity (flotation cells, filtration plant, slimes concentrator, drying plant).
3. No chemical reagents are used and the energy savings are quite unexpectedly large. Some estimates have reflected savings on energy alone of 60 to 75% per ton of concentrate. Reagent costs in flotation amount to about four times the energy costs. The most conservative estimates reflect a total saving in operating costs of at least 50%.
4. The dry HIMS concentrate is free-flowing and reasonably dust-free. Pneumatic classification can eliminate dust.
5. Autogenous milling results in more favourable particle size ditribution and savings of milling steel and eliminates capital and operating expenditure on secondary and tertiary crushing, stockpiling and handling of ore.
6. The larger particle size required for the process should reduce milling costs.
7. There are no effluent problems and no water requirements (except in connection with any treatment of undersize ores by flotation).
8. A phlogopite concentrate can be manufactured as a by-product at little or no additional cost.
9. The process is much less sensitive to variations in the feed ore composition.
10. No ageing effect is observed.

Preliminary experiments on induced roll machines indicate that with correct settings and recycling techniques similar grades and recoveries are attainable. For example, with the aid of an induced roll high intensity magnetic separator suitably manufactured by Eriez Magnetics Inc. of Erie, Pa. having a 75 cm roll length, the following results were obtained:

| Concentrate % $P_2O_5$ | % Recovery | Feed rate (ton per hour) |
|---|---|---|
| 38,8 | 59 | 5 |
| 37,4 | 87 | 4 |
| 38,6 | 72 | 3 |

EXAMPLE 2

Recovery of phlogopite from pyroxenite

The following table shows the relative percent phlogopite obtained in a single pass using a Frantz isodynamic separator with a transverse angle of 25°, a longitudinal angle of 10° and a field strength of approximately 5,000 Gauss (0.5 amps). The particle size range for the samples being 425/150 microns.

The non- (or weakly attracted) fraction consisted of apatite and diopside, to be separated as described in Example 1 (second and third stage).

| Expt. No. | Drill hole No. | Depth in feet | Relative % phlogopite reporting in magnetic fraction | % Recovery of magnetic fraction |
|---|---|---|---|---|
| 11 | 400/1200 | 0–112 | 98 | 90–95 |
| 37 | 600/1200 | 0–190 | 60 | 90–95 |

-continued

| Expt. No. | Drill hole No. | Depth in feet | Relative % phlogopite reporting in magnetic fraction | % Recovery of magnetic fraction |
|---|---|---|---|---|
| 26 | 400/1500 | 136–212 | 40 | 90–95 |
| 31A | 600/1525 | 106–197 | 95 | 90–95 |
| 8 | 400/1300 | 233–300 | 98 | 90–95 |
| 27 | 500/1400 | 248–308 | 98 | 90–95 |
| 35 | 600/1400 | 350–395 | 98 | 90–95 |
| 22 | 600/1300 | 383–438 | 95 | 90–95 |
| 7 | 400/1500 | 464–500 | 10 | 90–95 |
| 32 | 600/1525 | 428–500 | 95 | 90–95 |

The reason for the low relative percent phlogopite for experiments 37, 26 and 7, is due to the ore being diopsidic; i.e. there is very little phlogopite. The overall recovery of all the examples was in the range 90–95%. In such diopsidic ore the diopside has a non-typical behaviour, more similar to that of phlogopite than in the more typical ores.

The optimum recovery of phlogopite, with the highest grade occurs at a transverse angle of 10°, with a range of values between 7°–12°. The optimum recovery of apatite, with the highest grade occurs between 7°–12° with a mean value of 10°.

EXAMPLE 3

A flow sheet for the production by dry HIMS of phlogopite and apatite is shown in FIG. 1 and is self-explanatory.

The magnetic fraction of the second stage may be subjected to a further separation stage at 7,000 Gauss to recover additional phlogopite.

EXAMPLE 4: ONLY APATITE TO BE RECOVERED—DRY HIMS

Figure 2:
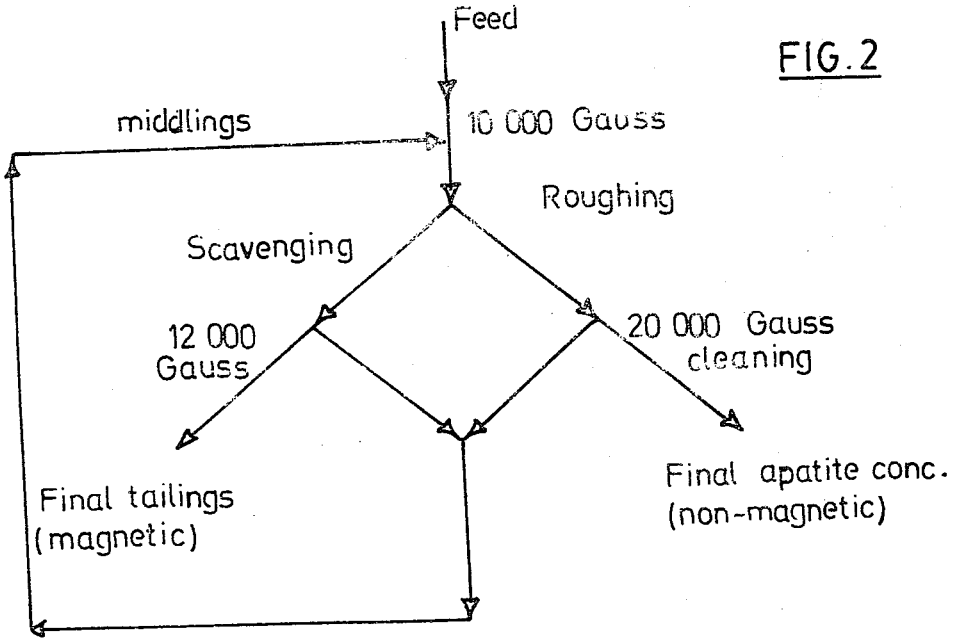
FIG. 2 is a partial flow diagram representing an alternate mode of the first portion of the procedure of FIG. 1.

The flow sheet of FIG. 2 applies which is self-explanatory in the light of the aforegoing.

EXAMPLE 5: ONLY APATITE TO BE RECOVERED—DRY HIMS

Figure 3:
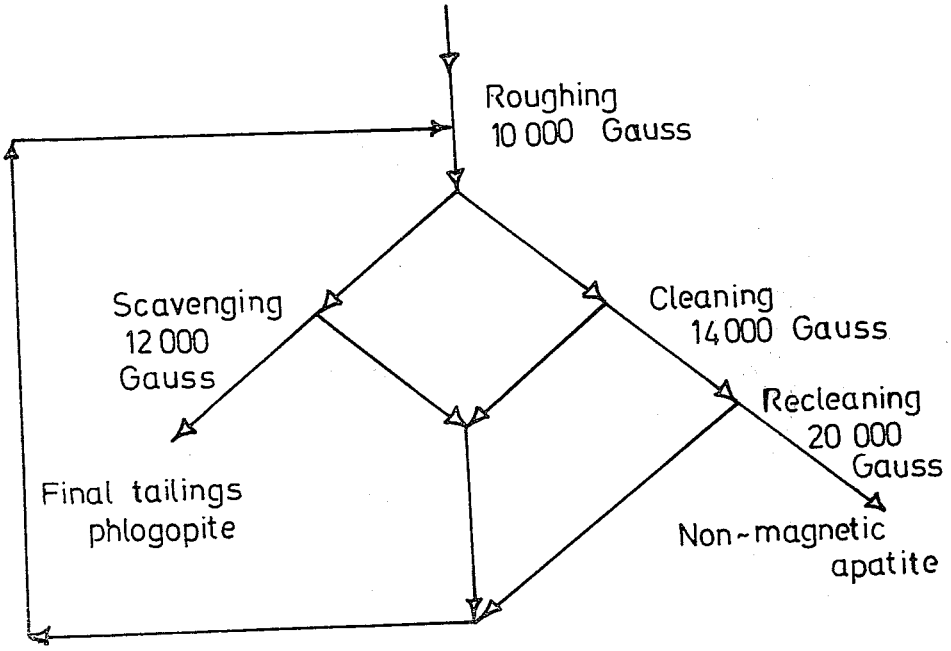
FIG. 3 is a partial flow diagram representing a further alternate mode of the first portion of the procedure of FIG. 1.

The flow sheet of FIG. 3 applies which is self-explanatory in the light of the aforegoing.

EXAMPLE 6: ONLY APATITE TO BE RECOVERED—DRY HIMS

Figure 4:
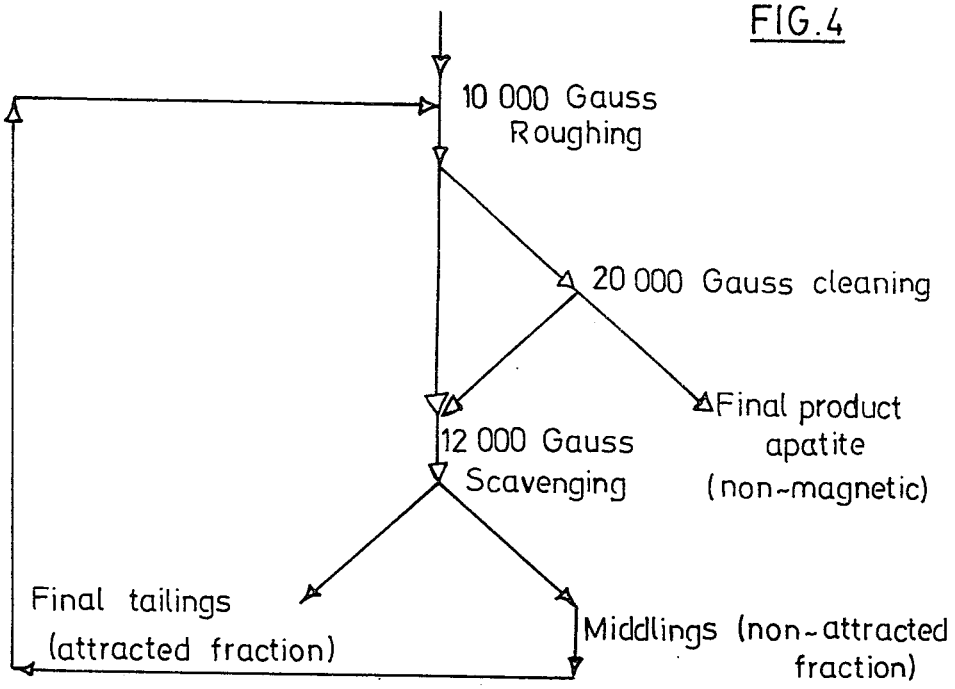
FIG. 4 is a partial flow diagram representing yet another alternate mode of the first portion of the procedure of FIG. 1.

The flow sheet of FIG. 4 applies which is self-explanatory in the light of the aforegoing.

EXAMPLE 7: RECOVERY OF APATITE, PHLOGOPITE AND DIOPSIDE BY DRY HIMS

Figure 5:
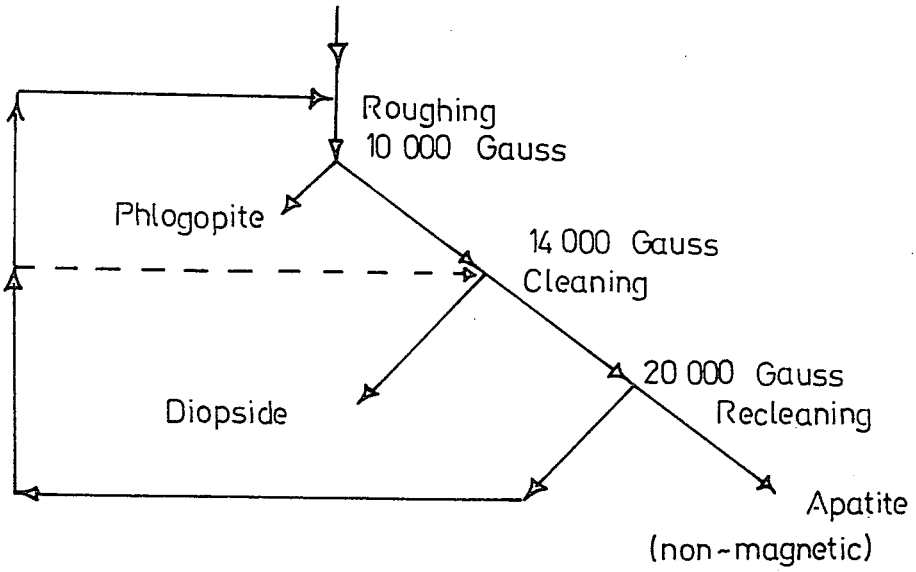
FIG. 5 is a partial flow diagram representing an additional alternate mode of the first portion of the procedure of FIG. 1.

The flow sheet of FIG. 5 applies which is self-explanatory in the light of the aforegoing.

EXAMPLE 8: PHLOGOPITE FROM TAILING

Tailings may be derived (a) from flotation process for the production of apatite;

(b) from Example 4, 5 or 6.

The tailings are subjected to a single dry HIMS step at 7,000 Gauss. The magnetic fraction is phlogopite.

Note: All of the aforegoing examples apply equally where phlogopite is partly or wholly changed to vermiculite.

EXAMPLE 9: DRY CONCENTRATION OF PYROXENITE ORE

Figure 6:
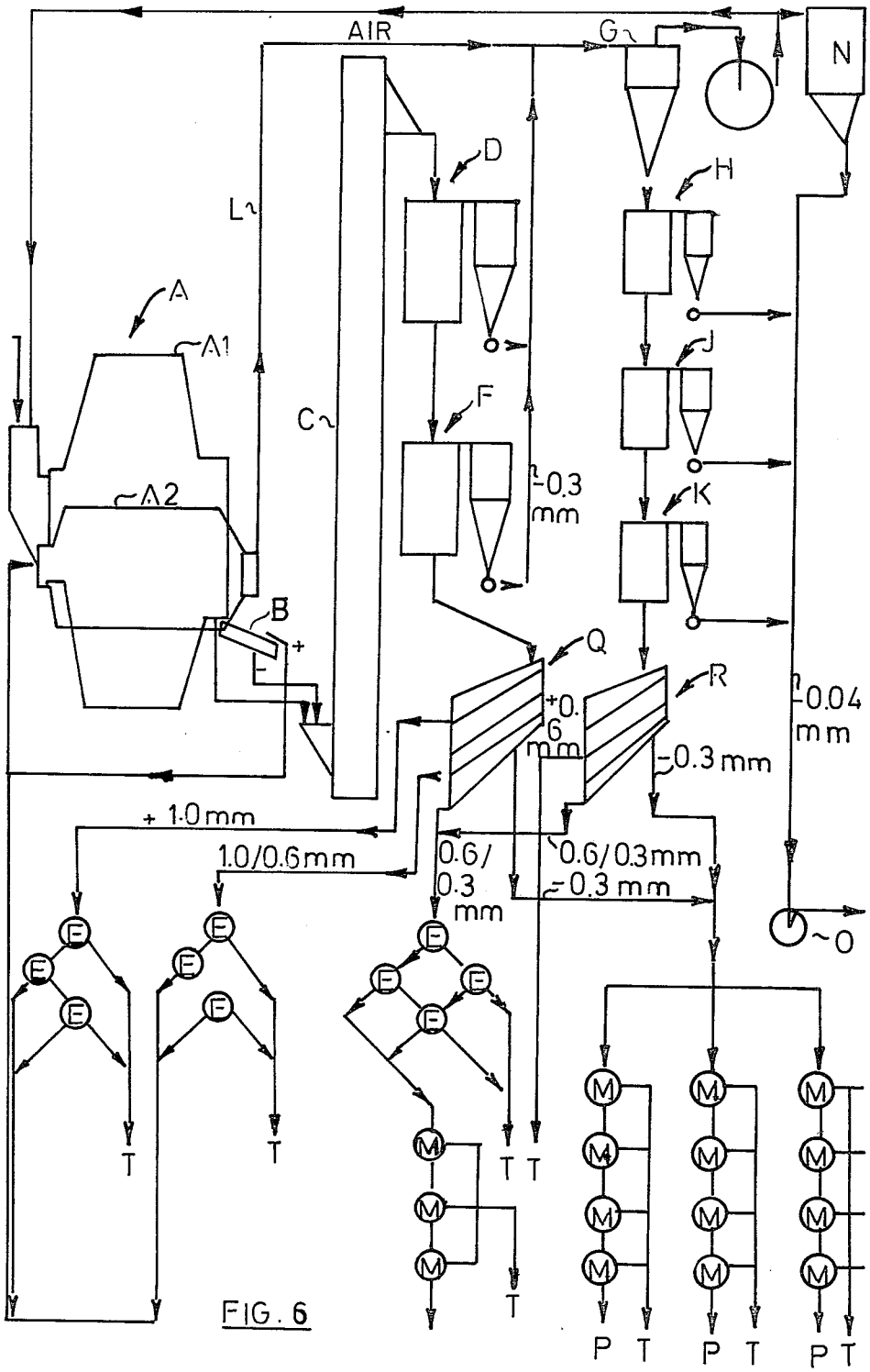
FIG. 6 is a flow diagram for the dry concentration of pyroxenite ore.

Referring to FIG. 6, which shows a typical flow sheet for dry concentration of pyroxenite ore, the symbols indicate the following process units:

A is a dry autogenous mill, either of the pancake type A1, or of the tube type A2.

Milling may take place in a single stage or in two stages, i.e. a dry autogenous mill may be followed by a dry pebble mill. Ball-milling is to be avoided when steel balls are used in view of the HIMS.

B is a screen, preferably of the vibratory type.

C is a bucket-type elevator.

D and F represent a two-stage classification step comprising two pneumatic classifiers known as Hukki classifiers, each of which function as will now be described more fully hereunder.

Although the heart of the Hukki classifier is the classifier unit which is shown in FIG. 7 and which may be used as a single-step classifier, the Hukki classifier comprises a classifier 10 connected in a closed air system in series to a vertical cyclone (not shown) which acts as a secondary classifier. The classifier 10 in turn comprises an air inlet 12, a mineral product inlet 14 connected via a star-valve 16 to the interior of the classifier 10. A flap 18 regulates the amount of air flowing past the inlet 14 and remote the inlet 14 from the flap 18.

Relatively large particles exit at 20 past the flaps 22. Finer particles exit at 24, the adjustable vane 26 determining the exact size distribution of particles exiting at 24 and those particles recirculating into the main airstream of the classifier 10.

Depending upon the nature of the operation, either the coarse or the finer particles can be led to the cyclone. In the preferred process, the finer particles will be led to the cyclone.

G is a vertical cyclone.

H, J and K are three smaller Hukki classifiers arranged in a three stage classification step for separating finer particles, e.g. $-89\mu$ from the mineral stream.

L represents a low speed air stream for sweeping dust, i.e. particles of $-40\mu$ from the mill A.

N is a dust house or collector.

O is a dust/water mixer for example for particle $-40\mu$ from where the mixture may be led for example to a flotation plant (not shown), or discarded, if desired.

Q and R are two dry screening devices such as two Mogensen sizers manufactured by Mogensen GmbH and Co. KG, 2,000 Wedel/Holstein, Federal Republic of Germany No. 7, 448 (1970) and Baumbach, Aufbereitungs-Technik No. 2, 72 (1975), each of which consists of a series of sloping screens having identical screen apertures. Each successive screen, however, slopes more steeply than the preceding screen, thereby to present smaller effective screen apertures to the material to be sized. In practice the sizers are vibrated to increase throughput. However, throughput for this type of sizer is generally not very high.

From the Mogensen sizers Q and R the coarse mineral fraction, i.e. $+600\mu$ is fed to electrostatic separators E as shown in the flow sheet, whilst the fine mineral fractions, i.e. $-300\mu$ are fed to dry HIMS as shown.

The 300–600$\mu$ mineral fraction is subjected firstly to electrostatic separation and thereafter to dry HIMS as shown.

P represents phosphate concentrates, i.e. apatite, whilst T represents mica minerals, e.g. phlogopite and/or diopside. The flow of mineral fraction is indicated in the flowsheet, whereby an effective classification of mineral particle sizes is obtained before dry HIMS.

The general flowsheet shown in FIG. 6 ensures inter alia that a minimal amount of dust is fed to the electrostatic separators, and that there is a maximal removal of coarse tailings by electrostatic separation.

Modification to the general flowsheet are exemplified below.

EXAMPLE 10

In the general flowsheet of FIG. 6, the screen B may preferably be replaced, through consideration of throughput and dust, by a coarse Hukki classifier passing $-1000\mu$ size particles to further classification and returning $+1000\mu$ size particles to the mill A.

EXAMPLE 11

In the general flowsheet of FIG. 6 a pneumatic pinched sluice, suitably, a Dryflo manufactured by Dry-Flo Separators, Ltd., Republic of South Africa separator explained in greater detail hereunder and shown in FIG. 8, may be used to separate micaceous and non-micaceous minerals between the screen B oversize and the return flow to the mill, the non-micaceous minerals being returned to the mill.

With reference to FIG. 8, the Dryflow separator comprises a downwardly sloped, wedge-shaped fluidised bed 30, including a low pressure air inlet 32, an air box 34, a porous deck 36, for example of a perforated plastics sheet, a single sluice 38, and a deflector plate or splitter (not shown) at 40.

Material for separation is introduced at 30.1 and the fluidized bed action of the separator tends to separate plate-type minerals which rise in the bed, from cubic type minerals which sink in the bed. At the sluice 38, the plate type of micaceous minerals T are split by the deflector plate 40 from the cubic type or phosphate minerals P.

Whilst a present limitation of the Dryflow separator as shown in FIG. 8 is its rather low throughput, it is possible to develop the wedge-shape into a semi-circle or full circle with the sluice at the centre thereof to obtain increased throughput. Several Dryflow separators may be used in parallel to increase throughput.

The bed 30 in FIG. 8 is totally enclosed in a closed air system for dust control. Because of the present throughput limitations, the Dryflow separator can only be used at an advanced stage in a flow scheme, e.g. before the first electrostatic separator for $+1000$ micron material.

EXAMPLE 12

In the general flowsheet of FIG. 6, the three systems of electrostatic separators may be replaced each with a Dryflo separator inter alia because there is no or very little dust in the feed fractions.

EXAMPLE 13

In the general flow sheet of FIG. 6, the Mogensen sizer Q may be replaced for example by two Hukki classifiers, one for the $+100$ micron size particles and one for the 600 to 1000 micron size particles. The Hukki fines (300 to 600 microns) consisting of coarse mica and fine cubic-type materials are then subjected to electrostatic separation and thereafter dry HIMS. In this way it may be possible to dispense with the two coarse electrostatic separation systems.

EXAMPLE 14

In the modified flow scheme of Example 13, the second Mogensen sizer R may also be replaced by two Hukki classifiers, one for the +600 micron and one for the 300-600 micron particle fractions. The +600 micron stream may be combined with the stream of 300-600 micron size prior to electrostatic separation followed by dry HIMS, instead of going to tailings.

EXAMPLE 15

In the modified flow scheme of Example 14, the Hukki classifiers H, J and K may be reduced to a two-stage classification if desired.

Before the final fines fraction (−40) micron is sent to the water mixer 0, it is further possible to subject the material to a 3-stage Hukki micron classification as disclosed in U.S. patent application Ser. No. 919,251 filed June 26, 1978 to separate +20-40 micron particles from −20 micron particles. The +20-40 micron fraction may then be subjected to a 4-stage dry HIMS for example to separate P and T, while the −20 micron fraction is led into the water mixer 0.

Alternatively, whilst the fines are further treated as described above, the electrostatic separators may be retained, as well as the electrostatic/HIMS step.

Naturally, any suitable combinations of the above modifications may be introduced into the general flow sheet, depending on the mineral product(s) and the desired objects.

Naturally, if lower product throughputs are desired, fewer HIMS units may be employed in parallel, for example only one four stage magnetic separator may be used. Depending upon higher or lower production throughputs, more or fewer of the process units shown in the above examples may be used.

Although the "Frantz" isodynamic HIMS separator may be used, it is equally possible to use a high intensity magnetic separator suitably as manufactured by Salzgitter Company having the particular arrangement of a non-magnetic strip located in the reciprocal pole.

Naturally any other suitable high intensity magnetic separator may be used in this process.

EXAMPLE 16

Figure 9:
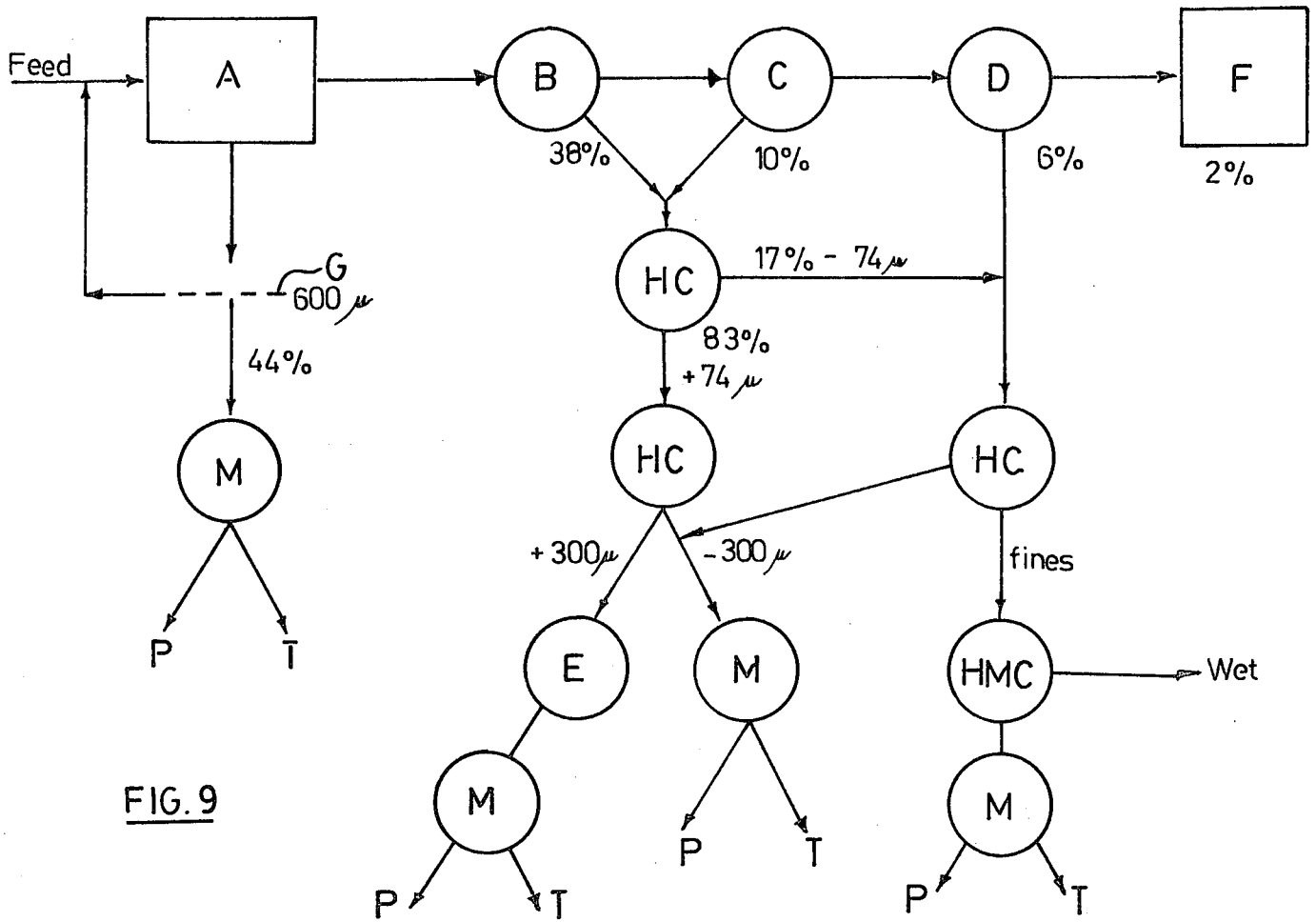
FIG. 9 is a schematic flow diagram for treatment of phosphate ore.

With reference to FIG. 9, a flow sheet is schematically shown for treating phosphate ore after grinding in a dry grinding mill suitably an Aerofall mill A. Dust and fines are removed by an air stream through a vertical cleaner (or air classifier) B, and serially through classifiers C and D to a dusthouse F. Percentage figures show the separation of various fractions achieved.

H C represents one or more Hukki classifiers, H M C one or more Hukki micro classifiers, E represents electrostatic separation, and M represents dry HIMS. P represents phosphate (apatite) and T represents tailings or micaceous material.

The screen G may be replaced by a (coarse) Hukki classifier (not shown), if desired.

HIMS and electrostatic separation may take place in a four-stage operation.

The invention must not be construed as being limited by the examples set out herein.

The claims set out hereunder are to be considered as being part of this disclosure.

We claim:

1. A process for the metallurgical treatment of apatite ore, which comprises subjecting a pyroxenite type ore in comminuted form and predominantly composed of articles in the size range of about 40 to 600 micron, as determined by screen analysis, to dry high intensity magnetic separation to recover a non-attracted fraction composed essentially of an apatite concentrate separated from silicate minerals of the pyroxenite ore as attracted fractions.

2. A process as claimed in claim 1, the silicate minerals comprising diopside and phlogopite and/or vermiculite.

3. A process as claimed in claim 2, including the step of recovering a weakly attracted fraction composed essentially of a magnetically attracted phlogopite and/or vermiculite concentrate separated from less strongly attracted diopside and non-attracted apatite.

4. A process as claimed in claim 3, wherein the ore is subjected to an initial stage having a magnetic field strength within the range of 5,000 Gauss to 10,000 Gauss to recover phlogopite and/or vermiculite from diopside and apatite and optionally to a second stage having an increased magnetic field strength.

5. A process as claimed in claim 4, wherein the magnetic field strength of the second stage is from 2,000 to 4,000 Gauss higher than the magnetic field strength of the initial stage.

6. A process as claimed in claim 1, the particle size range being about 100 to 400 micron.

7. A process as claimed in claim 1, the particle size range being about 120 to 350 micron.

8. A process as claimed in claim 1, the particle size range being about 150 to 300 micron.

9. A process as claimed in claim 1, in excess of about 70% of the comminuted ore being in the specified particle size range.

10. A process as claimed in claim 1, in excess of about 80% of the comminuted ore being in the specified particle size range.

11. A process as claimed in claim 1, in excess of about 90% of the comminuted ore being in the specified particle size range.

12. A process as claimed in claim 1, including the step of subjecting the comminuted ore to successive stages of increased magnetic field strength, commencing with a moderate initial magnetic field strength.

13. A process as claimed in claim 12, wherein the stages are substantially within the range of 6,000 to 20,000 Gauss, and wherein the initial stage is nearer the lower limit of the range and the final stage is at or near the upper limit.

14. A process as claimed in claim 12, the first stage being at or between 6,000 Gauss and 10,000 Gauss, and being followed by successive stages at 14,000, 16,000, and 20,000 Gauss.

15. A process as claimed in claim 12, including a low intensity magnetic scalper stage preceding the initial stage to remove ferromagnetic material from the comminuted ore.

16. A process as claimed in claim 1, including the step of separating fines material and subjecting this to a flotation process.

17. A process as claimed in claim 16, the fines material being about 40 micron and smaller in size.

18. A process as claimed in claim 16, the fines material being separated by wet high intensity magnetic separation.

19. A process as claimed in claim 1, including the step of subjecting the comminuted ore to pneumatic classification prior to the magnetic separation to classify the ore into the specified particle size range.

20. A process as claimed in claim 19, wherein the pneumatic classification is carried out by means of at least one closed circuit combined pneumatic classifier and cyclone unit.

21. A process as claimed in claim 1, including as a modification of the process, the step of subjecting a particle size fracton of the comminuted ore to electrostatic separation prior to the magnetic separation.

22. A process as claimed in claim 21, the particle size fraction being in the range of about 300 to 600 micron.

23. A process as claimed in claim 1, including the step of subjecting the ore to dry autogenous or semi-autogenous milling to obtain the desired degree of comminution.

24. A process as claimed in claim 1 which includes the steps of separating the ore in comminuted form and predominantly composed of particles in the size range of about 40 to 1000 micron, as determined by screen analysis, into three particle size streams, subjecting relatively fine particles to dry high intensity magnetic separation, subjecting medium size particles to dry high intensity magnetic separation preceded by electrostatic separation, and subjecting relatively coarse particles solely to electrostatic separation, to recover a non-attracted fraction composed essentially of an apatite concentrate separated from one or more weakly attracted fractions.

25. A process as claimed in claim 24, the relatively fine particles being in the size range of about 40 to 300 micron, the medium size particles being in the size range of about 300 to 600 micron, and the relatively coarse particles being in the size range of about 600 to 1000 micron.

26. A process as claimed in claim 24, including the step of subjecting the comminuted ore to pneumatic classification prior to the magnetic and/or the electrostatic separation.

27. A process as claimed in claim 26, the pneumatic classification being carried out by means of at least one closed-circuit combined pneumatic classifier and cyclone unit.

28. A process as claimed in claim 24, including the steps of subjecting the fine and medium size particles to successive stages of increased magnetic field strength, commencing with a moderate initial magnetic field strength.

29. A process as claimed in claim 28, the initial field strength being approximately 5,000 Gauss and the final magnetic field strength being approximately 20,000 Gauss.

30. A process as claimed in claim 29, the magnetic field strength being increased in successive stages from 12,000 Gauss to 16,000 Gauss and finally to 20,000 Gauss.

31. A process as claimed in claim 24, including a low intensity magnetic scalper stage preceding the initial stage to remove ferro-magnetic material from the comminuted ore.

32. A process as claimed in claim 24, including the step of subjecting the ore to dry autogenous or semi-autogenous milling to obtain the desired degree of comminution and separating oversize particles for re-milling.

33. A process as claimed in claim 32, separation of the oversize particles being carried out by pneumatic classification and/or sieving.

34. A process as claimed in claim 32, including the step of subjecting oversize particles to electrostatic separation prior to re-milling.

35. A process as claimed in claim 24, including the step of separating fines material and subjecting this to a flotation process.

36. A process as claimed in claim 35, the fines material being about 40 micron and smaller in size.

37. A process as claimed in claim 35, the fines material being separated by pneumatic classification.

38. A process for the metallurgical treatment of apatite ore, which comprises subjecting a pyroxenite type ore in comminuted form and predominantly composed of particles in the size range of about 40 to 600 micron, as determined by screen analysis, to dry high intensity magnetic separation to recover a weakly-attracted fraction composed essentially of a magnetically attracted phlogopite and/or vermiculite concentrate separated from less strongly attracted diopside and non-attracted apatite.

39. A process as claimed in claim 38, the particle size range being about 100 to 400 micron.

40. A process as claimed in claim 38, the particle size range being about 120 to 350 micron.

41. A process as claimed in claim 38, the particle size range being about 150 to 300 micron.

42. A process as claimed in claim 38, in excess of about 70% of the comminuted ore being in the specified particle size range.

43. A process as claimed in claim 38, in excess of about 80% of the comminuted ore being in the specified particle size range.

44. A process as claimed in claim 38, in excess of about 90% of the comminuted ore being in the specified particle size range.

45. A process as claimed in claim 38, including the step of subjecting the comminuted ore to successive stages of increased magnetic field strength, commencing with a moderate initial magnetic field strength.

46. A process as claimed in claim 45, wherein the ore is subjected to an initial stage having a magnetic field strength within the range of 5,000 Gauss to 10,000 Gauss to recover phlogopite and/or vermiculite from diopside and apatite and optionally to a second stage having an increased magnetic field strength.

47. A process as claimed in claim 46, including at least one further stage having a magnetic field strength increased successively to 20,000 Gauss to recover diopside from apatite.

48. A process as claimed in claim 38, including the step of separating phlogopite and vermiculite by air flow separation.

* * * * *

UNITED STATES PATENT AND TRADEMARK OFFICE

CERTIFICATE OF CORRECTION

PATENT NO. : 4,256,267

DATED : March 17, 1981

INVENTOR(S) : Burton, et al.

It is certified that error appears in the above-identified patent and that said Letters Patent are hereby corrected as shown below:

In the specification, Example 15, Column 13, Lines 18 and 25 -- delete "0", insert "O".

In the Claims, Claim 1, Column 14, Line 4 -- delete "articles", insert "particles".

Signed and Sealed this

*Eleventh* Day of *August 1981*

[SEAL]

*Attest:*

GERALD J. MOSSINGHOFF

*Attesting Officer*

*Commissioner of Patents and Trademarks*